US008303143B2

(12) United States Patent
Webb

(10) Patent No.: US 8,303,143 B2
(45) Date of Patent: Nov. 6, 2012

(54) RETRACTABLE LIGHT TOWER

(75) Inventor: Raymond C. Webb, Clemmons, NC (US)

(73) Assignee: Clark Equipment Company, Statesville, NC (US)

( * ) Notice: Subject to any disclaimer, the term of this patent is extended or adjusted under 35 U.S.C. 154(b) by 513 days.

(21) Appl. No.: 12/695,824

(22) Filed: Jan. 28, 2010

(65) Prior Publication Data

US 2011/0182066 A1 Jul. 28, 2011

(51) Int. Cl.
*F21S 8/08* (2006.01)

(52) U.S. Cl. ..... 362/413; 362/285; 362/414; 362/418; 362/431

(58) Field of Classification Search ..... 362/249.07, 362/249.1–249.11, 285, 384–386, 410, 413–414, 362/418, 431
See application file for complete search history.

(56) References Cited

U.S. PATENT DOCUMENTS

| | | | |
|---|---|---|---|
| 2,143,953 | A | 1/1939 | Le Roy |
| 2,461,429 | A | 2/1949 | Larson |
| 2,620,904 | A | 12/1952 | Le Roy |
| 2,806,562 | A | 9/1957 | Harman |
| 2,844,232 | A | 7/1958 | Le Roy |
| 3,242,476 | A | 3/1966 | Wheeler |
| 3,295,269 | A | 1/1967 | Schuster |
| 3,361,377 | A | 1/1968 | Trexler, Jr. |
| 3,385,397 | A | 5/1968 | Robinsky |
| 3,434,255 | A | 3/1969 | Rabenhorst |
| 3,564,789 | A | 2/1971 | Vyvyan et al. |
| 4,480,415 | A | 11/1984 | Truss |
| 4,651,480 | A | 3/1987 | Kramer |
| 4,757,577 | A | 7/1988 | Freeman |
| 4,920,710 | A | 5/1990 | Paine |
| 5,085,018 | A | 2/1992 | Kitamura et al. |
| 5,718,087 | A | 2/1998 | Featherstone et al. |
| 6,112,474 | A | 9/2000 | Paine |
| 6,571,914 | B2 | 6/2003 | Lee et al. |
| 7,357,365 | B2 | 4/2008 | Colman et al. |
| 2008/0196323 | A1 | 8/2008 | Colman et al. |

*Primary Examiner* — Jason Moon Han
(74) *Attorney, Agent, or Firm* — Michael Best & Friedrich LLP

(57) ABSTRACT

A portable light tower comprises a base and a mast. The mast is movable between a first configuration in which the mast is stored substantially within the base and a second configuration in which the mast extends in an upright position from the base. A light source is disposed on the base and a reflector is positioned on an end of the mast opposite the base. The reflector is configured to reflect light from the light source toward the surroundings of the light tower.

19 Claims, 5 Drawing Sheets

RETRACTABLE LIGHT TOWER

BACKGROUND

The present invention relates to portable lighting. Specifically, the invention relates to portable light towers for area lighting.

Current production portable light towers typically include telescoping masts that support a plurality of light sources at the top of the mast. The light sources can be heavy and cause the light tower to have a high center of gravity. In addition, the masts must retract or fold for transportation and can be difficult to configure or aim for use.

SUMMARY

In one embodiment, the invention provides a portable light tower comprising a base and a mast. The mast is movable between a first configuration in which the mast is stored substantially within the base and a second configuration in which the mast extends in an upright position from the base. A light source is disposed on the base and a reflector is positioned on an end of the mast opposite the base. The reflector is configured to reflect light from the light source toward the surroundings of the light tower.

In another embodiment, the invention provides a portable light tower. A base includes a housing that defines a base interior and an exterior. A plurality of mast segments are each movable between a stored position within the base interior and a use position in the exterior. Each mast segment is pivotally coupled to an adjacent mast segment when in the stored position and is fixedly connected to the adjacent mast segment when in the use position. Light sources are positioned within the base interior and are operable to project a plurality of light beams into the exterior. A curved reflector is coupled to one of the mast segments and is movable to an operating position at which the light beams are reflected toward the surroundings of the light tower.

In yet another embodiment the invention provides a portable light tower. A base includes a housing that defines a base interior and an exterior. A plurality of mast segments are connected to one another, with each mast segment arrangeable into a storage configuration or a use configuration. In the storage configuration, each of the plurality of mast segments is pivotally connected to an adjacent mast segment such that the mast segments can be one of rolled and folded for efficient storage within the base interior. In the use configuration, each of the plurality of mast segments is fixedly connected to an adjacent mast segment such that the mast segments can be extended to define a substantially rigid mast that extends above the base in the exterior. A plurality of light sources is positioned within the base interior and operable to project a plurality of light beams into the exterior. A semi-spherical reflector is coupled to one of the mast segments and movable to an operating position at which the light beams are reflected toward the surroundings of the light tower.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
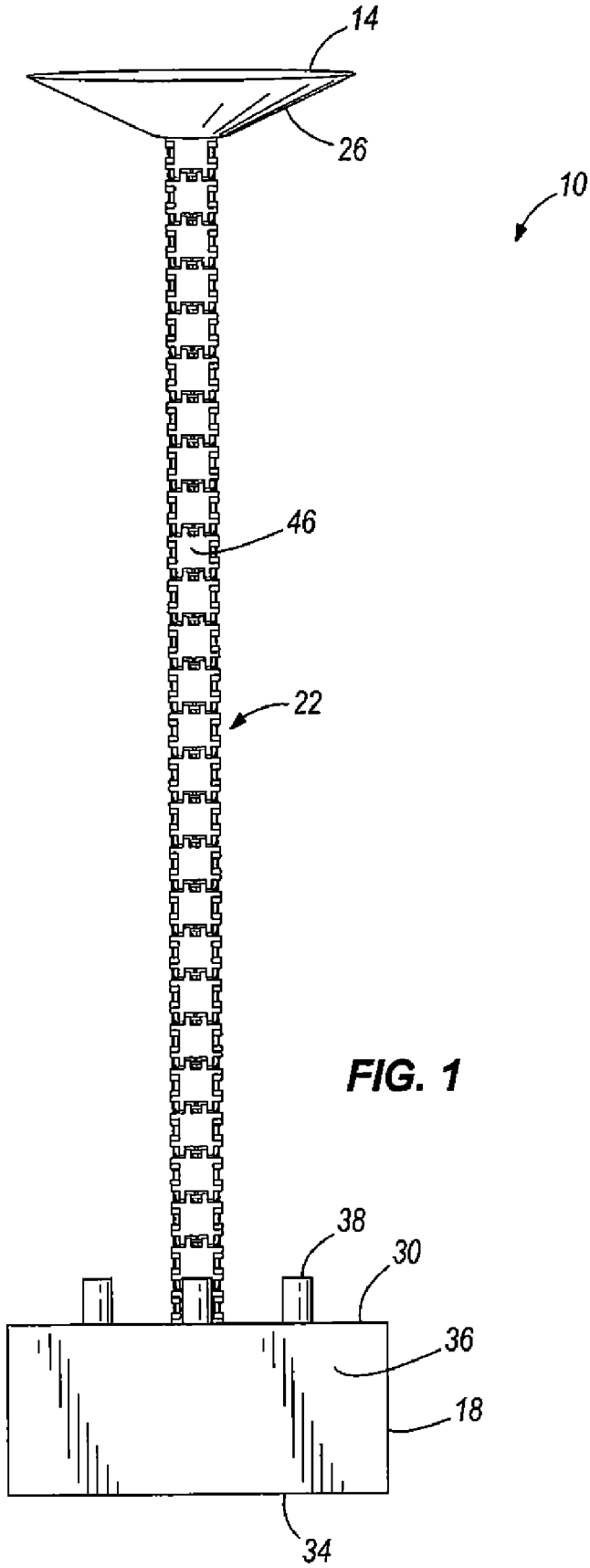
FIG. 1 is a side view of an extendable tower supporting a reflector for area lighting.

FIG. 1 shows a portable light tower 10 such as for use in applications such as area lighting at a construction site. The tower includes a reflector body 14, a base portion 18, and a mast 22 extending between the reflector body 14 and the base portion 18. The reflector body 14 is formed as an inverted cone or dome of plastic or light gauge metal, and has a reflective lower surface 26 that efficiently reflects the light. The reflective lower surface 26 of the reflector body 14 can be formed from plastic that is coated with a mirrored film, or formed from a polished metal (e.g., aluminum). In another construction, a plurality of mirrors act as the reflector body 14. In this construction, the mirrors may be individually movable to direct the light in the desired direction or pattern. In still other constructions, a flexible reflector body can be distorted slightly to direct light as desired.

The base 18 has a top surface 30, a bottom surface 34 and side surfaces 36. The base 18 provides a suitable footprint (at the bottom surface 34) and low center of gravity to support the mast 22 and reflector 14 when the mast is fully extended, as illustrated. A plurality of spotlights 38 extends outwardly from the top surface 30 of the base portion. The spotlights 38 are positioned such that, when powered their beams shine onto the lower surface 26 of the reflector and provide area lighting for the tower's surroundings. Four spotlights 38 are used in the embodiment shown, though one skilled in the art will recognize that any suitable arrangement or combination of lights could be used. In addition, any suitable type of lamp could be used, including LED, incandescent, fluorescent, arc, etc.

Figure 2:
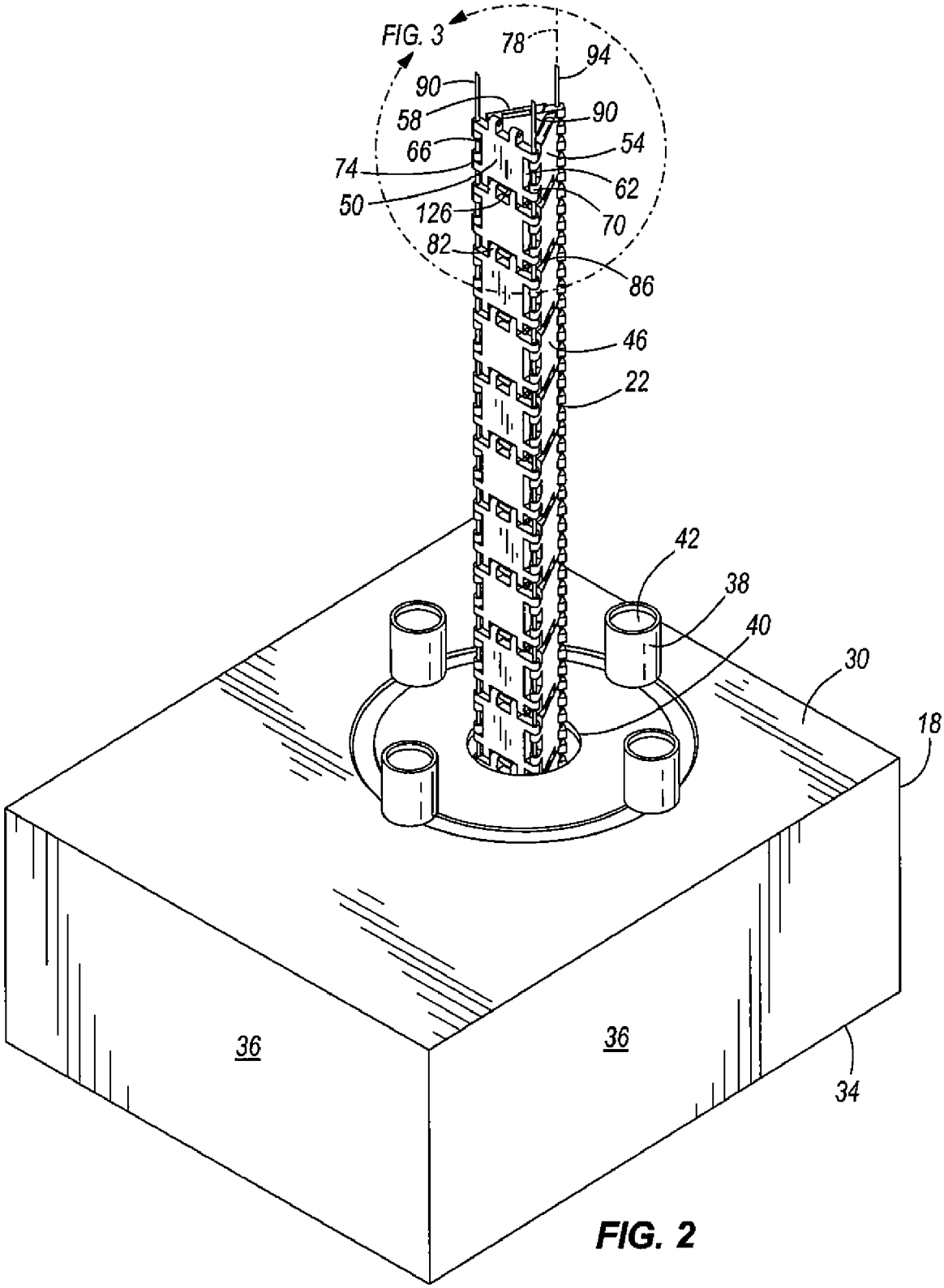
FIG. 2 is a perspective of a base portion and mast of the tower of FIG. 1.

Turning to FIG. 2, the base 18 is schematically illustrated as a cube that includes the top surface 30, the bottom surface 34, and side surfaces 36 that substantially enclose a space. While not illustrated, the base either sits on or is built as part of a trailer assembly. The trailer assembly includes wheels and is connectable to a vehicle to allow the light tower 10 to be towed. It should be noted that the base 18 is illustrated as being cubic for simplicity. The actual shape of the base is not relevant to the invention, other than for providing sufficient space for other components. Thus, the invention should not be limited to the shape or arrangement of the base illustrated herein.

The space may be sized to contain the power generation equipment needed to operate the light tower. For example, some constructions include a battery bank that stores the necessary power. Other constructions may include a generator set that includes a prime mover (e.g., internal combustion or turbine engine, etc.) that power a generator to provide the necessary power. Also included within the base are any controls or electronic systems that may be included with the light tower. The base protects these components from the elements and from other damage that could occur.

As illustrated in FIG. 2, the top surface 30 includes a first aperture 40 that allows for the passage of the light tower as it extends and retracts. A number of lamp apertures 42 are positioned around the first aperture 40 and allow the spotlights 38 to direct a beam of light toward the reflector. Similarly, when in the retracted position, at least a portion of the light tower is disposed within the base. The mast 22 of the tower 10 extends outwardly from the top surface 30 of the base such that the mast 22 is substantially perpendicular to the top surface 30. It should be appreciated that the base 18 and mast 22 of the illustrated tower 10 could also be used in other applications such as a mounting tower for an infrared heater or a trainable spot lamp in place of the reflector body.

The mast 22 is an assembly of multiple mast segments 46 linked to one another in series. In the extended position shown in FIGS. 1 and 2, each mast segment 46 is interlocked with the adjacent mast segments to form a rigid support structure. Furthermore, in the extended position illustrated, each individual mast segment 46, and the extended mast 22 as a whole, has a triangular cross-section. Of course other arrangements could form another cross section, such as a rectangle or polygon.

References to "vertical," "top," "bottom," and "horizontal" surfaces herein describe the relative orientation of the pieces when compared to the top surface of the base and their features when the mast is extended and the pieces are rigidly connected. In most applications, the top surface 30 of the base 18 will be substantially parallel to the surrounding ground, and therefore, "horizontal" in the usual sense.

Figure 3:
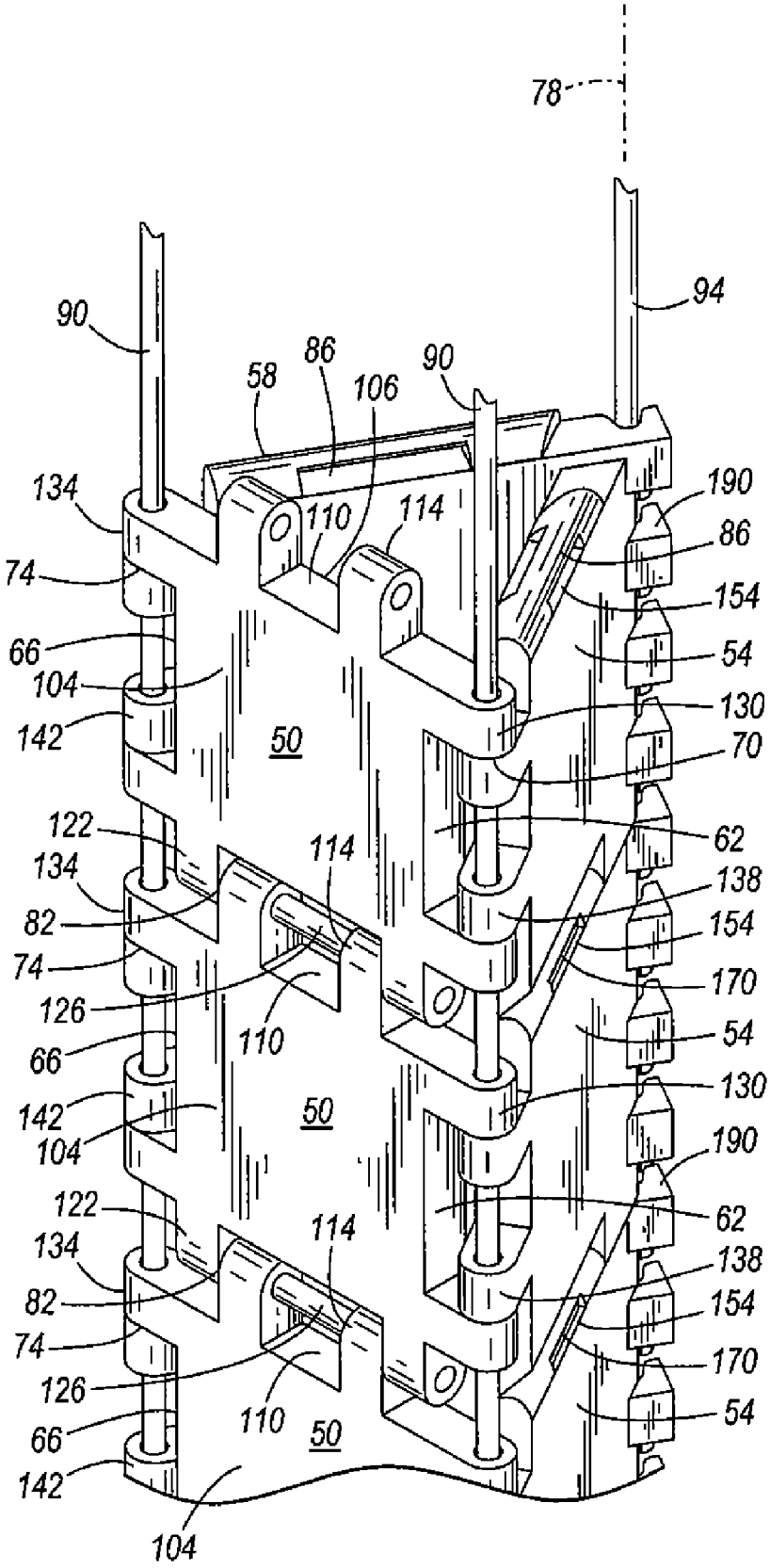
FIG. 3 is a close-up perspective of multiple mast segments of the tower of FIG. 1.

As illustrated in FIG. 3, each individual mast segment 46 of the mast 22 is composed of three interlocking planar members: a backpiece 50, a first sidepiece 54 and a second sidepiece 58. In the preferred embodiment, the planar members are made from a molded plastic. Alternatively, the planar members may be unitarily cast, stamped, extruded, or otherwise formed from aluminum, steel, other metals, or other suitable materials.

The first sidepiece 54 and second sidepiece 58 are pivotally hinged to a first edge 62 and a second edge 66 of the backpiece 50 at a first side hinge 70 and a second side hinge 74, respectively. First and second corners of the rigid, triangular mast segment 46 correspond to the first side hinge 70 and second side hinge 74, respectively. A third corner of the rigid, triangular mast segment 46 lies along a common vertical axis 78 between the first sidepieces 54 and second sidepieces 58. The mast segments 46 are also interlocked together at the top and bottom by horizontal hinges 82 that connect the backpieces 50 and by a tongue and groove arrangement 86 on each of the first sidepieces 54 and second sidepieces 58. In some embodiments, the planar members may have embedded metal hinge bushings or pivots to extend their useful life.

Figure 4:
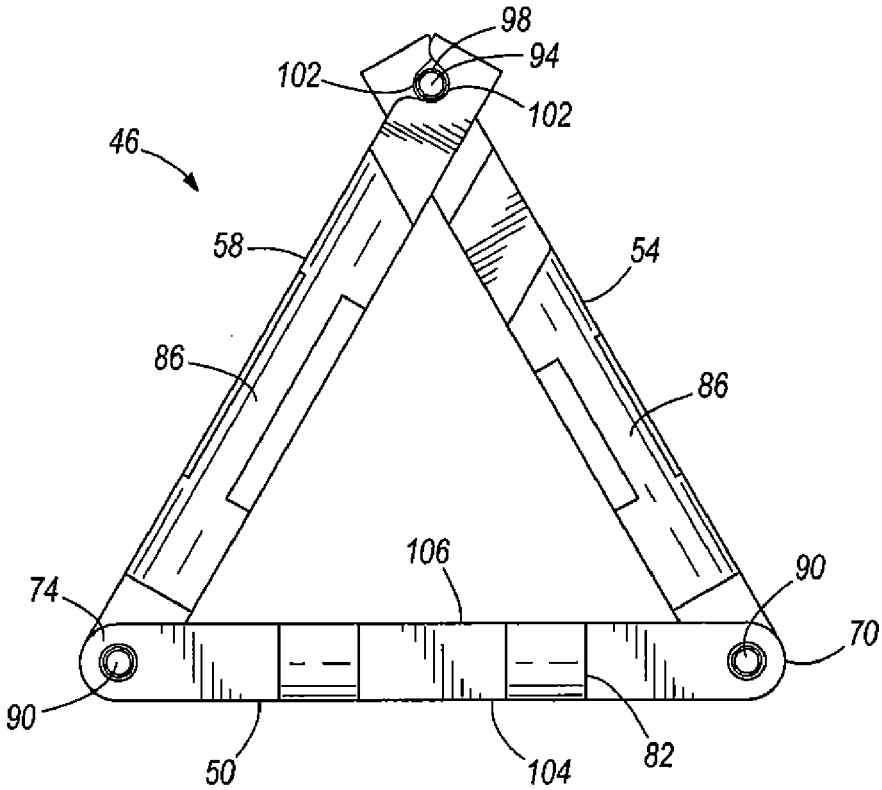
FIG. 4 is a top view of the segment of FIG. 3, displayed in a rigid position.

One plastic sheathed steel cable 90 is permanently fed through each of the vertical first side hinges 70 and second side hinges 74 of the mast segments 46 the entire length of the mast 22. The two cables 90 are not needed to hold the mast segments 46 together, but are used to tension the extended mast 22. As shown in FIG. 4, a third cable 94 is inserted through a circular bore 98 formed by vertical channels 102 of the first and second sidepieces 54, 58. The channels 102 align along the common vertical axis 78 to form the circular bore 98. The third cable 94 serves to keep the first sidepieces 54 and second sidepieces 58 interlocked when the mast 22 is extended and to tension the extended mast along with the two other cables 90. One of skill in the art will recognize that various metal, glass, carbon, or polymer wires and cables may be substituted for the sheathed steel cables.

Referring to FIG. 3 again, the backpiece 50 of each segment has square or rectangular front and back surfaces 104, 106. Along a top edge 110, a pair of upper hinge members 114 extends upwards vertically. Along an opposite, bottom edge 118, a pair of lower hinge members 122 extends downward vertically. The upper hinge members 114 and lower hinge members 122 are complimentarily nested such that the upper hinge members 114 of one backpiece align with the lower hinge members 122 of the adjacent backpiece to form the horizontal hinges 82. The entire string of mast segments 46 comprising the mast 22 is pre-assembled with pivot pin members 126 through each of the corresponding top and bottom hinges 82. Thus, once the mast 22 is assembled, each three piece mast segment 46 is pivotally linked to both of the adjacent three piece mast segments at all times.

Figure 5:
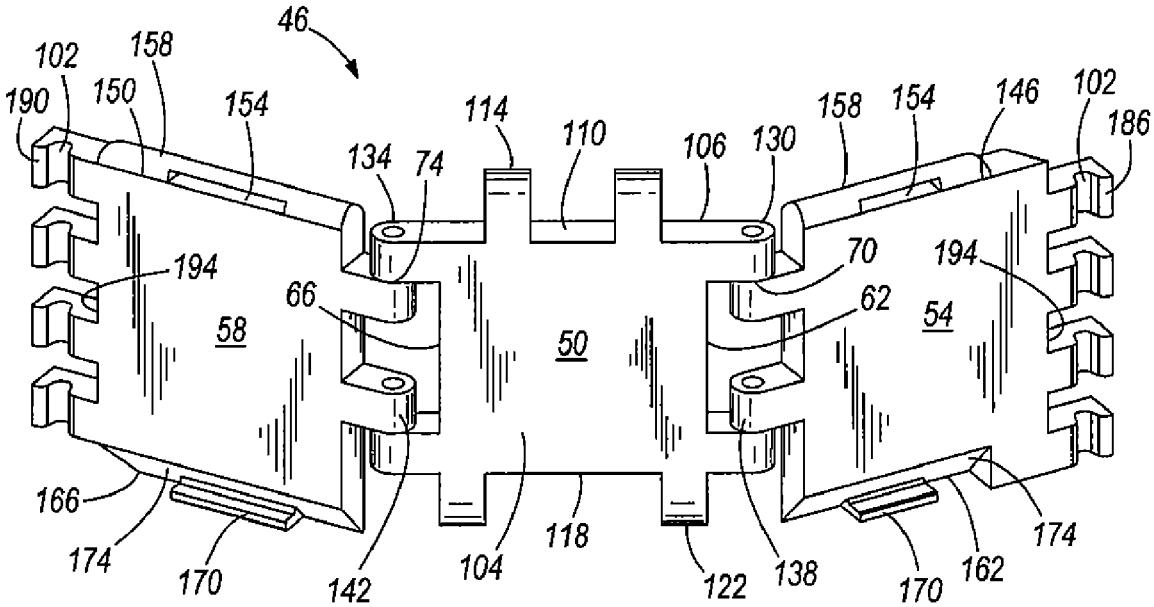
FIG. 5 is a perspective of a multi-link mast segment of the tower mast of FIG. 1, displayed in an unlocked position.

FIG. 5 illustrates various additional aspects of the backpiece 50, first sidepiece 54 and second sidepiece 58 of one mast segment 46. FIG. 5 illustrates these three components in an unlocked position, in contrast to the rigid configuration illustrated in FIGS. 1-4. For the purposes of illustration, the pivot pin members and cables are not shown. A first pair of side hinge members 130 and a second pair of side hinge members 134 extend outward horizontally along the first vertical edge 62 and the second vertical edge 66, respectively. The first side hinge members 130 and second side hinge members 134 are nested and aligned with corresponding side hinge members 138 of the first side piece 54 and side hinge members 142 of the second sidepieces 58 to form side hinges 70 and 74.

A recessed groove 154 is formed into a radiused ridge 158 along a top edge 146 of the first sidepiece 54 and a top edge 150 of the second sidepieces 58. A tongue 170 projects outwardly from an angled surface 174 along the opposite, bottom edge 162 of the first sidepiece 54 and bottom edge 166 of the second sidepiece 58. Also illustrated in FIGS. 3 and 4, this "tongue and groove" arrangement 86 provides structural rigidity to the mast 22 as the sidepieces of adjacent mast segments 42 interlock. The angled surface 174 and radiused ridge 158 allow the adjacent segments to smoothly lock and unlock from one another while the mast segments transition from an unlocked configuration to the rigid, extended position.

Interlocking members 186 and 190 project outwards in sets of four along vertical edge 178 of the first sidepiece and vertical edge 182 of the second sidepiece, respectively. Each of the four interlocking members 186 and 190 has the radiused channel 102 formed therein. In some embodiments, compliant pads are glued, co-molded or otherwise applied to vertical planar segments 194 between each of the interlocking members. The illustrated construction includes four interlocking members with more or fewer interlocking members being possible.

As illustrated in FIG. 3, the vertical positions of the interlocking members 186 are offset by approximately the width of one interlocking member when compared to the vertical positions of the interlocking members 190. When each mast segment is in the rigid configuration shown in FIGS. 1-4, the interlocking members 186 and 190 of the respective first and second sidepieces nest with one another. Furthermore and as previously discussed in regard to FIG. 4, the corresponding semi-circular channels 102 of the first and second interlocking members 186 and 190 align vertically, thereby forming the complete circular bore 98 through which the third cable 94 may pass and be captured.

Figure 6:
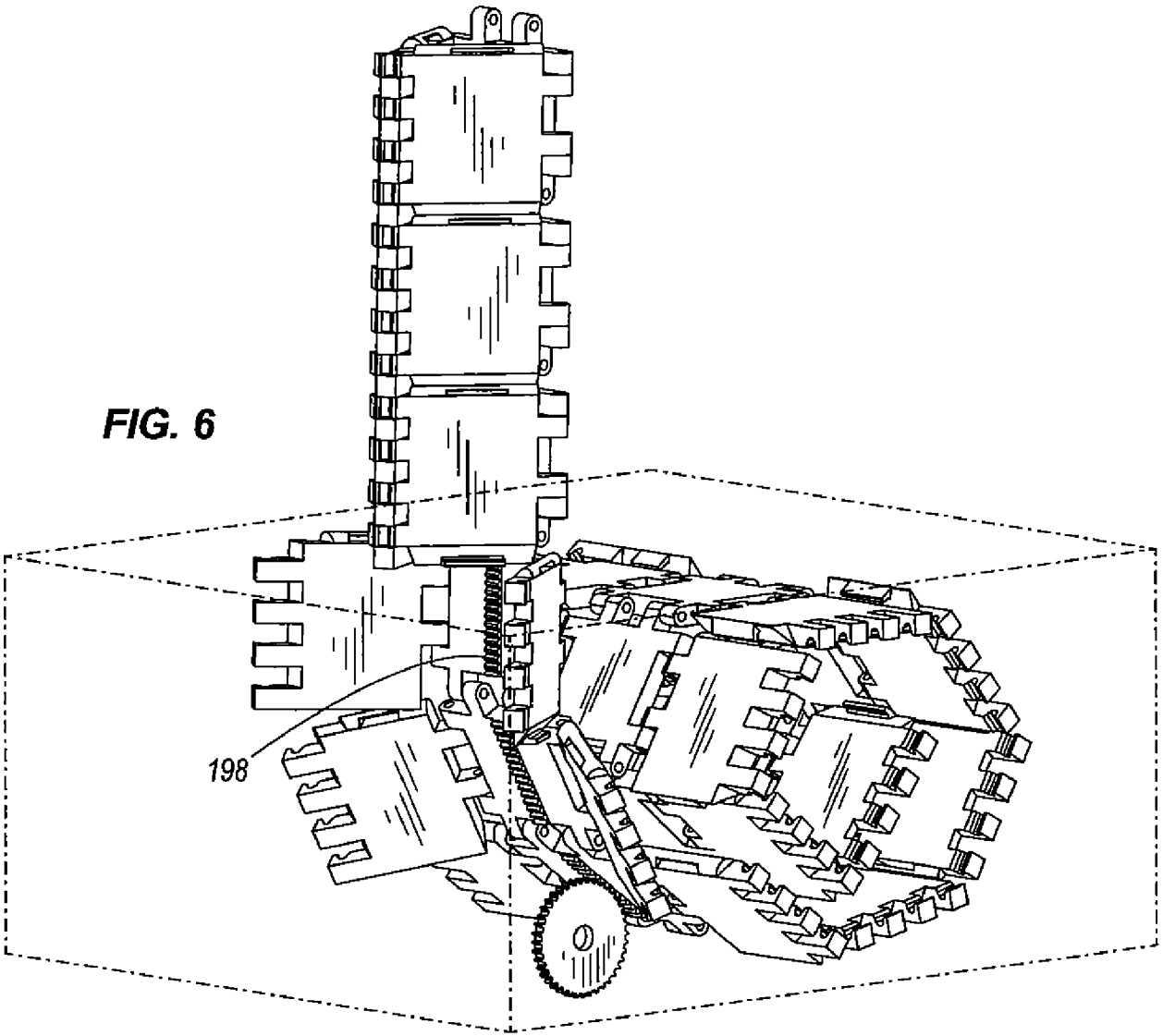
FIG. 6 is an internal perspective of the base portion of FIG. 2, illustrating the mast in a partially stowed position and one embodiment of a drive mechanism.

As illustrated in FIG. 6, the back surface 106 of the backpiece 50 may include an arrangement of gear teeth forming a rack 198 of a rack and pinion arrangement. In one embodiment, the rack 198 may be integrally molded into the back surface 106 of the backpiece 50. In some embodiments, the lands of the rack teeth may be level with the back surface, while in other embodiments, the lands of the rack teeth may be raised above the back surface.

During transportation or other periods of non-use, the light tower 10 of the present invention is self-contained within the base 18. The pivotally connected mast segments 46 are stored flat, in the unlocked position. In the flat arrangement, the mast segments can be rolled or can be stacked to reduce the storage volume need for the mast. When the mast 22 is extended, the triangular cross-section is formed as each respective mast segment is pulled upwards by the mast section above, which is driven by gears that engage each face of the triangle. As the first sidepieces 54 and second sidepieces 58 interlock, the rubber inserts imbedded along the edge of the interlocking portion are compressed. The third cable 94 is then inserted into the circular bore 98. Once the interlocked sections exit the top surface of the base, the rubber inserts expand. This expansion causes the third cable to be locked into place by the interlocking portion of the sidepieces. When the mast is fully extended, the three cables are individually tensioned to compress the mast sections together.

To use the light tower 10, an engine, motor, or other drive member operates to unroll or unstack the mast segments 46. The first mast segment 46 supports the reflector 26 and fixedly engages a first end of each of the three cables 90 and 94. A guide forces the free ends of the side segments 54 and 58 to move toward one another and into engagement with the third cable 94 positioned within the partial openings of the interlocking members 186 and 190. As the mast 22 moves upward, subsequent mast segments 46 are guided into the triangular arrangement and engage the preceding mast segment 46. Once the mast 22 reaches a desired height, a tension is applied to each of the three cables 90 and 94. The tension serves to further rigidize the mast structure.

With the mast 22 positioned as desired, power is provided to the light sources 38. The light sources 38 illuminate the reflector 26 which reflects the light downward to illuminate the desired area. Because the light reflector is relatively lightweight, it could include small motors that would allow the user to remotely adjust the position and/or shape of the reflector to assure that the reflector properly illuminates the desired area.

To retract the mast 22, the tension is released from the three cables 90 and 94 and the engine or motor is reversed. As the mast segments 46 enter the base 18, a guide separates the interlocking members 186 and 190, moves the mast segment 46 toward the flat arrangement and disengages the mast segment from the adjacent segment. The mast segments 46 are the returned to their storage position.

The arrangement of the light tower 10 also facilitates maintenance since all of the major operating components remain on the ground. For example, in conventional light towers, the mast must be lowered replace a light. In the present system, the light sources remain on the ground and can be easily changed without moving the mast.

Furthermore, the present arrangement retracts into a compact arrangement that allows for easy transport.

Thus, the invention provides, among other things, an extendable tower supporting a reflector for area lighting. Various features and advantages of the invention are set forth in the following claims.

What is claimed is:

1. A portable light tower comprising:

a base;

a mast movable between a first configuration in which the mast is stored substantially within the base and a second configuration in which the mast extends in an upright position from the base, wherein the mast is formed by a plurality of mast segments interconnected in series, each mast segment comprising three planar members pivotally connected to one another;

a light source disposed on the base; and a reflector positioned on an end of the mast opposite the base, the reflector configured to reflect light from the light source toward the surroundings of the light tower.

2. The portable light tower of claim 1, wherein each mast segment comprises:

a backpiece having a front side, a back side, and first, second, third and fourth edges, wherein the first edge is opposite and parallel to the second edge, the third edge is perpendicular and adjacent the first edge, and the fourth edge is opposite and parallel to the third edge;

a first sidepiece, pivotally coupled along a first edge of the first sidepiece to the first edge of the backpiece; and a second sidepiece, pivotally coupled along a first edge of the second sidepiece to the second edge of the backpiece.

3. The portable light tower of claim 2, wherein each mast segment is pivotally coupled along the third and fourth edges of the backpiece to the fourth and third edges, respectively, of the backpieces of the adjacent mast segments such that when the mast is in the first configuration, the mast can be rolled upon itself for compact stowage and when the mast is in the second configuration, the first and second sidepieces of each mast segment pivots about the first and second edge of each backpiece to form a rigid mast with a triangular cross section.

4. The portable light tower of claim 3, further comprising first and second cable members, wherein the first and second sidepieces of each mast are pivotally coupled to their respective backpiece by the first and second cable members being permanently fed through a plurality of hinge members along the first and second edges of the backpieces such that the mast may be tensioned by applying a strain to the first and second flexible wire members.

5. The portable light tower of claim 4, wherein the first and second cable members are plastic sheathed steel cables.

6. The portable light tower of claim 4, further comprising a third cable, wherein the third cable is inserted into a bore of a circular channel along a common axis of the first sidepiece and second sidepiece when the mast is transitioned from the first configuration to the second configuration and removed from the bore of the circular channel when the mast is transitioned from the second configuration to the first configuration such that the third cable maintains the first and second sidepieces of each mast segment in interlocked alignment when the mast is in the second configuration.

7. The portable light tower of claim 6, wherein each of the first and second sidepieces of each mast segment further comprises a tongue member along a third edge perpendicular to the first and second edges of the sidepiece, and a groove member along a fourth edge opposite and parallel third edge, such that the first and second sidepieces of each mast segment may interlock with the first and second sidepieces, respectively, of the adjacent mast segments.

8. The portable light tower of claim 6, wherein the plane between each interlocking member of each sidepiece has a compliant surface.

9. A portable light tower comprising:

a base including a housing that defines a base interior and an exterior;

a plurality of mast segments each movable between a stored position within the base interior and a use position in the exterior, each mast segment pivotally coupled to an adjacent mast segment when in the stored position and fixedly connected to the adjacent mast segment when in the use position, wherein each of the plurality of mast segments includes three planar members pivotally connected to one another;

a plurality of light sources positioned within the base interior and operable to project a plurality of light beams into the exterior; and a curved reflector coupled to one of the mast segments and movable to an operating position at which the light beams are reflected toward the surroundings of the light tower.

10. The portable light tower of claim 9, further comprising a stiffening member coupled to the base and operable to rigidize the plurality of mast segments in the use position.

11. The portable light tower of claim 10, wherein the stiffening member includes a cable connected to a first of the plurality of mast segments and the base, the tension within the cable being controllable to produce a desired stiffness of the mast segment.

12. The portable light tower of claim 9, wherein the three planar members pivot about first and second cables.

13. The portable light tower of claim 9, wherein each mast segment is movable from to a stored position in which the planar members are positioned in a flat arrangement to a use position in which the planar members are positioned in a triangular arrangement.

14. The portable light tower of claim 12, wherein the plurality of mast segments is arranged as a single series of adjacent mast segments.

15. The portable light tower of claim 13, wherein the plurality of mast segments is operable to form a roll of mast segments is in the storage position.

16. A portable light tower comprising:

a base including a housing that defines a base interior and an exterior;

a plurality of mast segments connected to one another, each mast segment arrangeable into a storage configuration or a use configuration, in the storage configuration, each of the plurality of mast segments being pivotally connected to an adjacent mast segment such that the mast segments can be one of rolled and folded for efficient storage within the base interior, in the use configuration, each of the plurality of mast segments being fixedly connected to an adjacent mast segment such that the mast segments can be extended to define a substantially rigid mast that extends above the base in the exterior, wherein each of the plurality of mast segments includes three planar members pivotally connected to one another;

a plurality of light sources positioned within the base interior and operable to project a plurality of light beams into the exterior; and a semi-spherical reflector coupled to one of the mast segments and movable to an operating position at which the light beams are reflected toward the surroundings of the light tower.

17. The portable light tower of claim 16, wherein the base enclosure is operable to align and guide the mast segments when transitioning between storage and use configurations.

18. The portable light tower of claim 16, wherein each mast segment comprises:

a back piece;

a first side piece; and a second side piece;

wherein the first side piece is pivotally connected to a first edge of the back piece and the second side piece is pivotally connected to a second edge of the backpiece, the second edge parallel to the first edge.

19. The portable light tower of claim 18, wherein each mast segment forms a rigid triangle in the use configuration, the back piece, first side piece and second side piece each forming a side of the triangle.

* * * * *